US008147035B2

(12) United States Patent
Hosono et al.

(10) Patent No.: US 8,147,035 B2
(45) Date of Patent: Apr. 3, 2012

(54) FLUID DISCHARGING APPARATUS AND METHOD OF CONTROLLING THE FLUID DISCHARGING APPARATUS

(75) Inventors: Satoru Hosono, Azumino (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 315 days.

(21) Appl. No.: 12/163,820

(22) Filed: Jun. 27, 2008

(65) Prior Publication Data

US 2009/0002448 A1 Jan. 1, 2009

(30) Foreign Application Priority Data

Jun. 29, 2007 (JP) ..... 2007-172807

(51) Int. Cl.
*B41J 2/14* (2006.01)

(52) U.S. Cl. ..... 347/47; 347/29; 347/30; 347/44

(58) Field of Classification Search ..... 347/47, 347/29, 30, 44
See application file for complete search history.

(56) References Cited

U.S. PATENT DOCUMENTS

2005/0168519 A1* 8/2005 Umeda ..... 347/29
2005/0253909 A1* 11/2005 Usui ..... 347/92
2006/0132533 A1* 6/2006 Mochizuki ..... 347/30
2007/0085874 A1* 4/2007 Shindo ..... 347/30
2008/0007605 A1* 1/2008 Sakurai et al. ..... 347/92

FOREIGN PATENT DOCUMENTS

| | | |
|---|---|---|
| JP | 10-305594 | 11/1998 |
| JP | 2003-534165 | 11/2003 |
| JP | 2005-053119 | 3/2005 |
| JP | 2005-153389 | 6/2005 |
| JP | 3126938 | 11/2006 |
| WO | 2006/060845 | 6/2006 |

* cited by examiner

*Primary Examiner* — Ellen Kim
(74) *Attorney, Agent, or Firm* — Workman Nydegger

(57) ABSTRACT

A fluid discharging apparatus including a head, a medium support portion, a contact member, and an actuator portion. The head includes a plurality of nozzles through which a fluid is discharged onto a target medium. The medium support portion supports the medium. The contact member is provided within the medium support portion. The actuator portion moves at least one of the head and the medium support portion so that the plurality of nozzles are located close to or far from the contact member. During a standby state when fluid is not discharged onto the medium, the contact member is brought into contact with the head in order to seal the plurality of nozzles, and in a discharging state, the head is located away from the contact member in order to provide a space through which the medium is allowed to pass between the plurality of nozzles and the contact member.

13 Claims, 8 Drawing Sheets

FLUID DISCHARGING APPARATUS AND METHOD OF CONTROLLING THE FLUID DISCHARGING APPARATUS

CROSS-REFERENCE TO RELATED APPLICATIONS

This application claims the benefit of Japanese Patent Application No. 2007-172807, filed Jun. 29, 2007, which is expressly incorporated herein by reference in its entirety.

BACKGROUND OF THE INVENTION

1. Technical Field

The present invention relates to a fluid discharging apparatus and a method of controlling the fluid discharging apparatus.

2. Related Art

An ink jet printer is one example of a fluid discharging apparatus currently known in the art. In one ink jet printers disclosed in Japanese Patent No. JP-A-2005-53119, the printer includes a plurality of nozzles arranged along the width direction of paper in a so-called line head. The disclosed printer uses a cap member to cover the nozzles in order to suppress vaporization of the ink solvent, or the like. In addition, other cap members which are capable of closing the openings of nozzles, have been described, such as the cap member disclosed in Japanese Patent No. JP-A-10-305594.

In the above described printers, the cap members are provided separately. In some instances, however, the separate configuration causes difficulties when a large cap member that extends over the overall width of paper is needed, adherence between the cap member and to the head becomes poor. This may be caused by various reasons, including the formation of gaps between the cap member and the head because of insufficient rigidity, or the like, as the size of the cap member is increased.

BRIEF SUMMARY OF THE INVENTION

An advantage of some aspects of the invention is that it ensures adherence to the head using a member that has a sufficient rigidity.

An aspect of the invention provides a fluid discharging apparatus. The fluid discharging apparatus includes a head, a medium support portion, a contact member, and an actuator portion. The head includes a plurality of nozzles through which a fluid is discharged onto a medium. The plurality of nozzles are provided over the width of the head in a direction that is orthogonal to the transport direction of the medium. The medium support portion is arranged at a position that faces the plurality of nozzles and supports the medium. The contact member is provided for the medium support portion. The actuator portion moves at least one of the head and the medium support portion so that the plurality of nozzles are moved towards and away from the contact member. When the fluid discharging apparatus is on standby and is not discharging the fluid onto the medium, the contact member is brought into contact with the head to close openings of the plurality of nozzles. When the fluid discharging apparatus is discharging the fluid onto the medium, the head is located away from the contact member so as to provide a space, through which the medium is allowed to pass, between the openings of the plurality of nozzles and the contact member.

Other aspects of the invention may be apparent from the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

General Configuration of Printer 1

Figure 1:
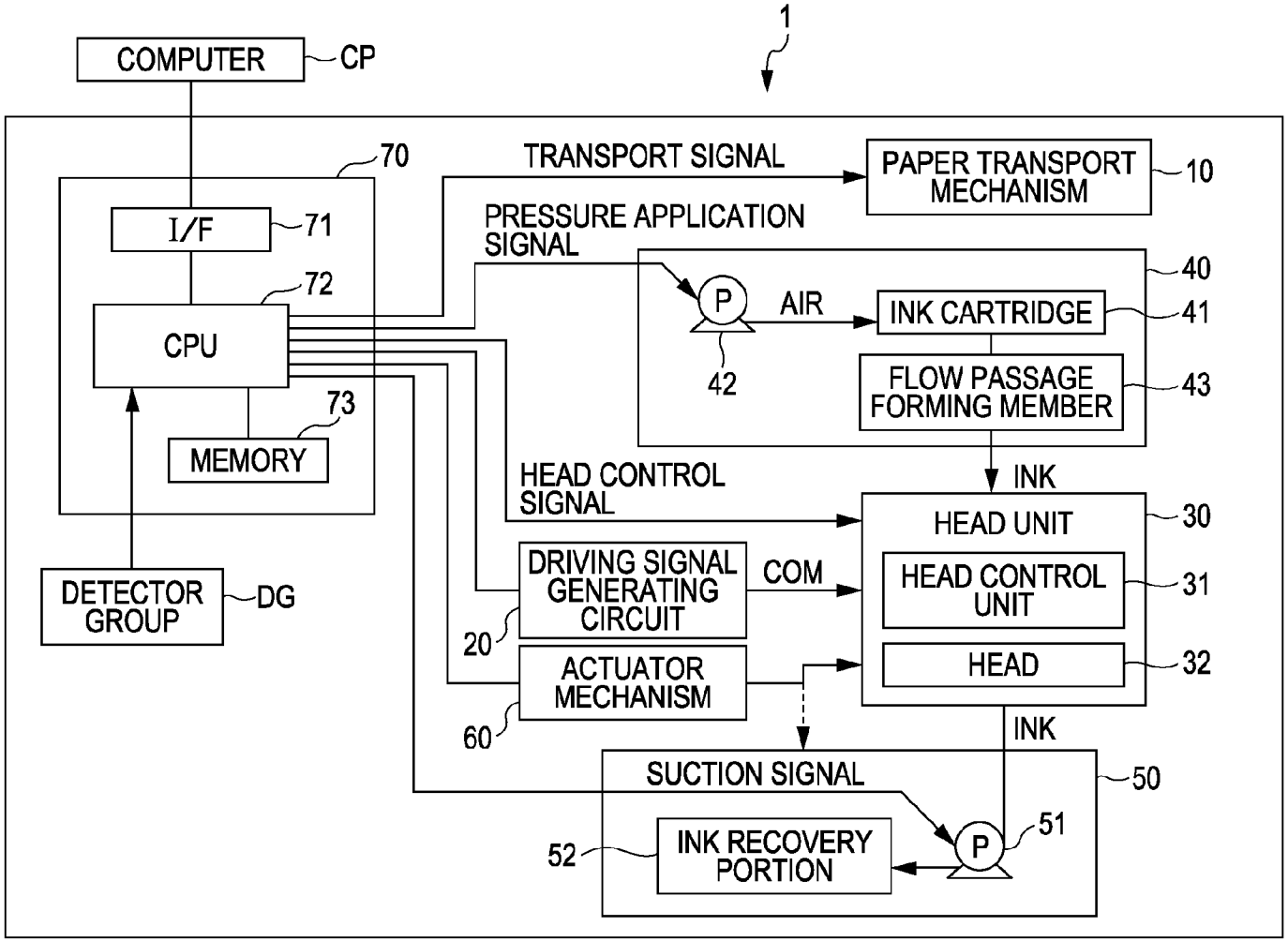
FIG. 1 is a block diagram that illustrates the configuration of a printer.

FIG. 1 is a block diagram that illustrates the configuration of a printer 1. The exemplified printer 1 may be regarded as an example of a fluid discharging apparatus that is capable of performing aspects of the invention. The printer 1 discharges ink, which is a kind of fluid, toward a medium, such as paper, cloth, or film. The printer 1 discharges four colors of ink, consisting of black ink, cyan ink, magenta ink, and yellow ink. The medium is an object to which a fluid is discharged and is, for example, a sheet of paper.

The printer 1 includes a paper transport mechanism 10, a driving signal generating circuit 20, a head unit 30, an ink supply mechanism 40, an ink recovery mechanism 50, an actuator mechanism 60, a detector group DG, and a printer-side controller 70. The paper transport mechanism 10 may be regarded as a medium transport portion that transports a medium. The paper transport mechanism 10 transports a sheet of paper, which serves as a medium, in a predetermined transport direction. The driving signal generating circuit 20 functions as a driving signal generating portion and generates a driving signal COM that is used to discharge ink. The driving signal COM is supplied to a head 32 of the head unit 30. Then, the driving signal COM is applied to a driving element of the head 32, which may comprise a heater element, piezoelectric element, or the like. The head unit 30 includes a head control portion 31 and the head 32. The head control portion 31 controls application of the driving signal COM to each driving element. That is, the head control portion 31 applies a necessary portion of the driving signal COM to each driving element on the based on a head control signal transmitted from the printer-side controller 70. The head 32 is a portion that discharges ink. The ink supply mechanism 40 is a portion that supplies the head 32 with ink. In the present embodiment, four colors of ink, consisting of black ink, cyan ink, magenta ink and yellow ink, are supplied to the head 32. The ink recovery mechanism 50 recovers ink that is depleted from the head 32. The ink recovery mechanism 50 includes a suction pump 51 and an ink recovery portion 52. In addition, in the printer 1, a platen 13 (see FIG. 4A, or the like), which comprises a paper transport mechanism 10, also functions as a portion of the ink recovery mechanism 50. The actuator mechanism 60 is a mechanism that moves the head 32 in a predetermined direction. The actuator mechanism 60 may be regarded as a kind of actuator portion. Note that the paper transport mechanism 10, the head 32, the ink supply mechanism 40, the ink recovery mechanism 50 and the actuator mechanism 60 will be described more fully below.

The detector group DG includes a plurality of detectors that monitor the status of the printer 1. Then, signals detected by the detectors are output to the printer-side controller 70. The printer-side controller 70 is a portion that is the main controller in the printer 1. The printer-side controller 70 controls various portions on based on the print data received from the computer CP or signals detected by the detector group DG and causes the printer 1 to print out an image on a sheet of paper. For example, the printer-side controller 70 outputs a transport signal to the paper transport mechanism 10 to cause the paper transport mechanism 10 to transport a sheet of paper. The printer-side controller 70 outputs a pressure application signal to the ink supply mechanism 40. The printer-side controller 70 outputs a suction signal to the ink recovery mechanism 50 to cause the ink recovery mechanism 50 to recover ink that has been ejected from the head 32. The printer-side controller 70 includes an interface portion 71, a CPU 72 and a memory 73. The interface portion 71 executes transmission and reception of data with the computer CP. The CPU 72 is a processing device that executes overall control in the printer 1. The memory 73 stores various pieces of information used for the CPU 72.

Relevant Parts of Printer 1

Head 32

Figure 2:
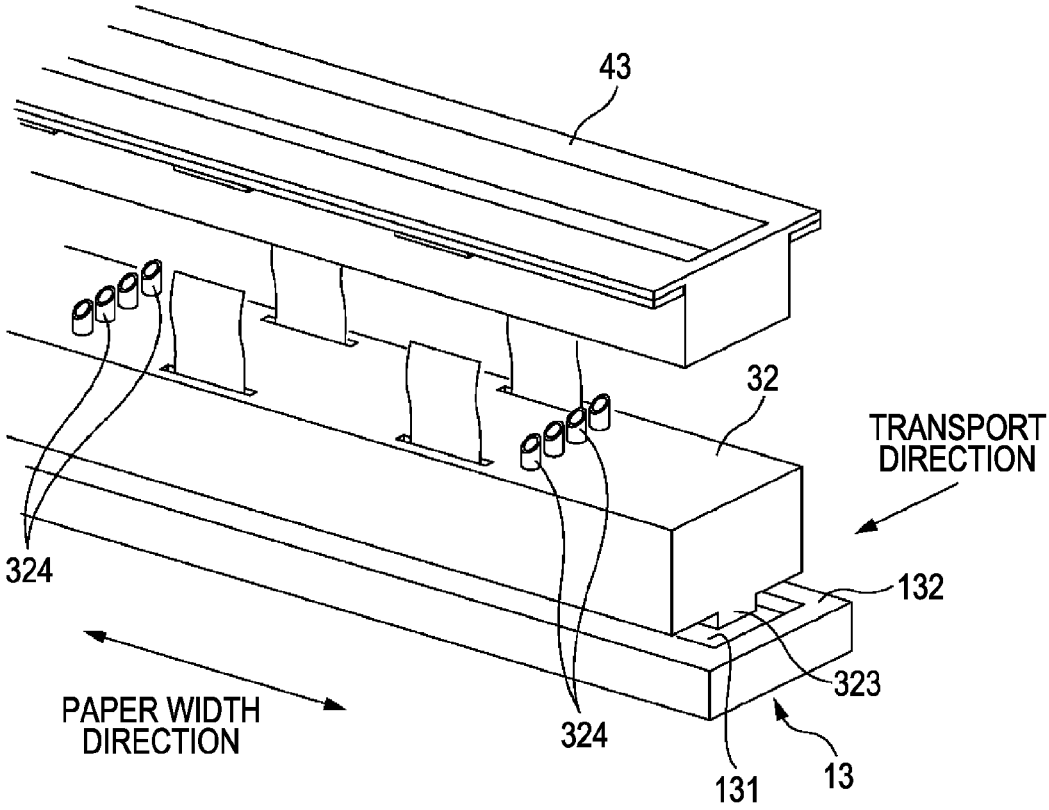
FIG. 2 is a perspective view that illustrates a head and portions around the head.
Figure 3A:
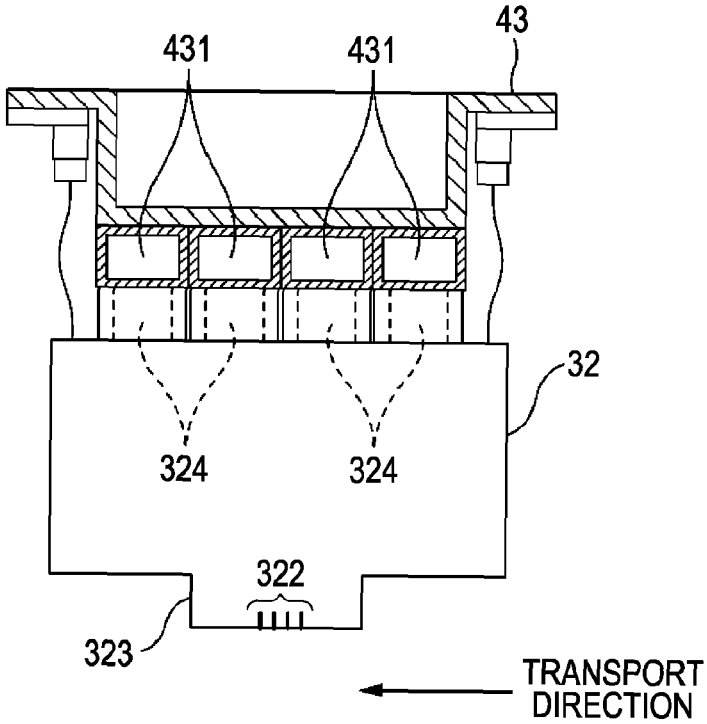
FIG. 3A is a side view of the head.
Figure 3B:
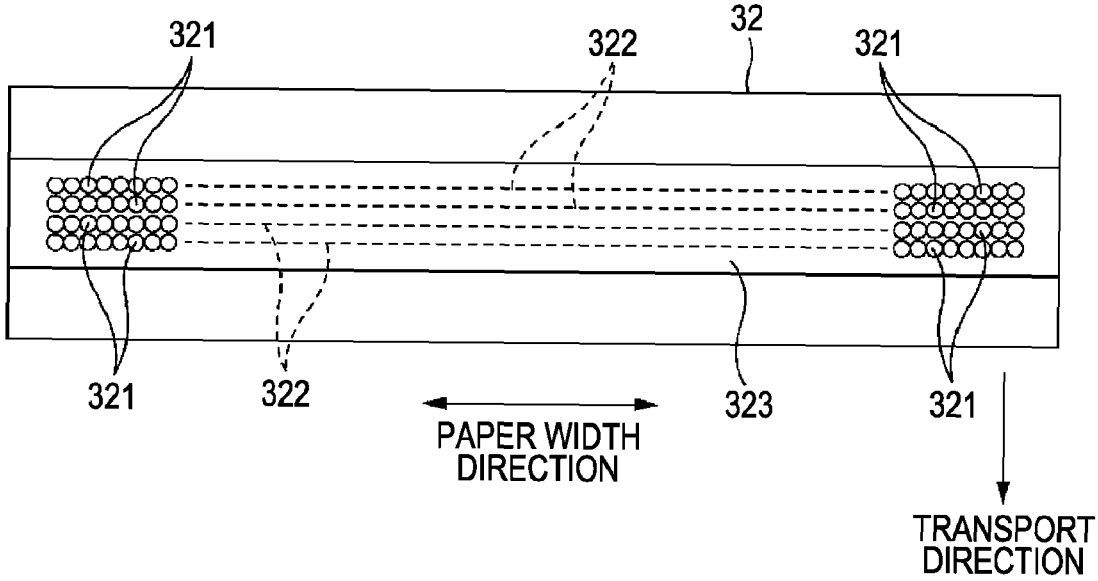
FIG. 3B is a bottom view of the head.

The head 32 is used to discharge ink, which is a kind of fluid, and has a rectangular parallelepiped appearance as partially shown in FIG. 2. The head 32 is attached in such a manner that the longitudinal direction of the head 32 is aligned with the width of the paper (hereinafter, referred to as paper width direction). As shown in FIG. 3B, the head 32 has a plurality of nozzles 321 through which ink is discharged. The plurality of nozzles 321 are provided on the bottom surface of the head 32. The plurality of nozzles 321 are provided at an extended portion 323 provided on the bottom face of the nozzles 321. The extended portion 323 extends in the longitudinal direction of the head 32 (paper width direction). The plurality of nozzles 321 are also provided so that they are arranged at a predetermined pitch along the longitudinal direction of the head 32 and form nozzle columns 322. The nozzle columns 322 are provided in a length that is equal to or larger than the maximum printable width. Thus, in the printer 1, it is possible to print an image at a desired position on a sheet of paper in a single transportation of the sheet of paper. The plurality of nozzle columns 322 are provided in correspondence with discharged ink colors (in correspondence with types of fluid). Because four colors of ink are discharged in the head 32, four nozzle columns 322 are provided. Each of the nozzle columns 322 is provided in an offset in position in the transport direction that is orthogonal to the paper width direction (in the printer 1, the paper width direction is substantially perpendicular to the transport direction). For the sake of convenience, the open face of the nozzles 321 in the extended portion 323 is also referred to as a nozzle face.

In the head 32, a driving element (not shown) is provided which corresponds with each of the nozzles 321. As the driving signal COM generated by the driving signal generating circuit 20 is applied to a driving element, the driving element operates to discharge ink. For example, when the driving element is a heater element, the heater element rapidly heats up through application of the driving signal COM. Then, ink expands or bubbles because of the heating, and thereby ink is discharged from the nozzle 321. In addition, when the driving element is a piezoelectric element, the piezoelectric element deforms by application of the driving signal COM. This deformation applies a pressure to the ink in a pressure chamber, causing the ink to be discharged from the nozzle 321. In this manner, it is possible to control discharging of ink for each of the nozzles 321.

Ink Supply Mechanism 40

The ink supply mechanism 40 may be regarded as a fluid supply portion. As shown in FIG. 1, the ink supply mechanism 40 includes an ink cartridge 41, a pressure application pump 42, and a flow passage forming member 43.

The ink cartridge 41 is an ink storage portion that stores ink and is provided in such a form that a user can replace it. The ink cartridge 41 includes a case (not shown) and an ink package that is accommodated inside the case (not shown). The inside of the case is airtight, and the ink package is pressurized by compressed air that is fed from the pressure application pump 42. The ink package is in fluid communication with the flow passage forming member 43 through a tube. Thus, by applying pressure to the ink package, ink is supplied to the side of the flow passage forming member 43. Here, ink flow passages in the head 32 are formed continuously to the nozzles 321. Therefore, in accordance with the degree to the pressure applied to the ink, it is possible to supply ink to the head 32 and forcibly drain the ink in the head 32 from the nozzles 321.

Note that, because ink is supplied through the flow passage forming member 43 to the head 32, the pressure application pump 42 may be regarded as a pressure application portion that applies pressure to ink stored in the ink cartridge 41 in order to supply the ink to the side of the head 32. Then, in the printer 1, the pressure application pump 42 operates in accordance with a pressure application signal from the printer-side controller 70.

The flow passage forming member 43 is provided between the ink cartridge 41 and the head 32 and supplies the head 32 with ink that is supplied from the side of the ink cartridge 41. As shown in FIG. 2 and FIG. 3A, the flow passage forming member 43 in the printer 1 is attached on the upper surface of the head 32, which is opposite to the nozzle face. Individual flow passages 431, the number of which corresponds to the number of types of ink (four, in this example), are provided inside the flow passage forming member 43 to where the ink may flow. In addition, a plurality of connecting tubes 324 are formed which extend from the upper face of the head 32. These connecting tubes 324 may be regarded as introducing portions that introduce ink in the individual flow passages 431 to the inside of the head 32. That is, the connecting tubes 324 are inserted in the corresponding individual flow passages 431, so that ink in the individual flow passages 431 flow into the head 32.

Paper Transport Mechanism 10

Figure 5A:
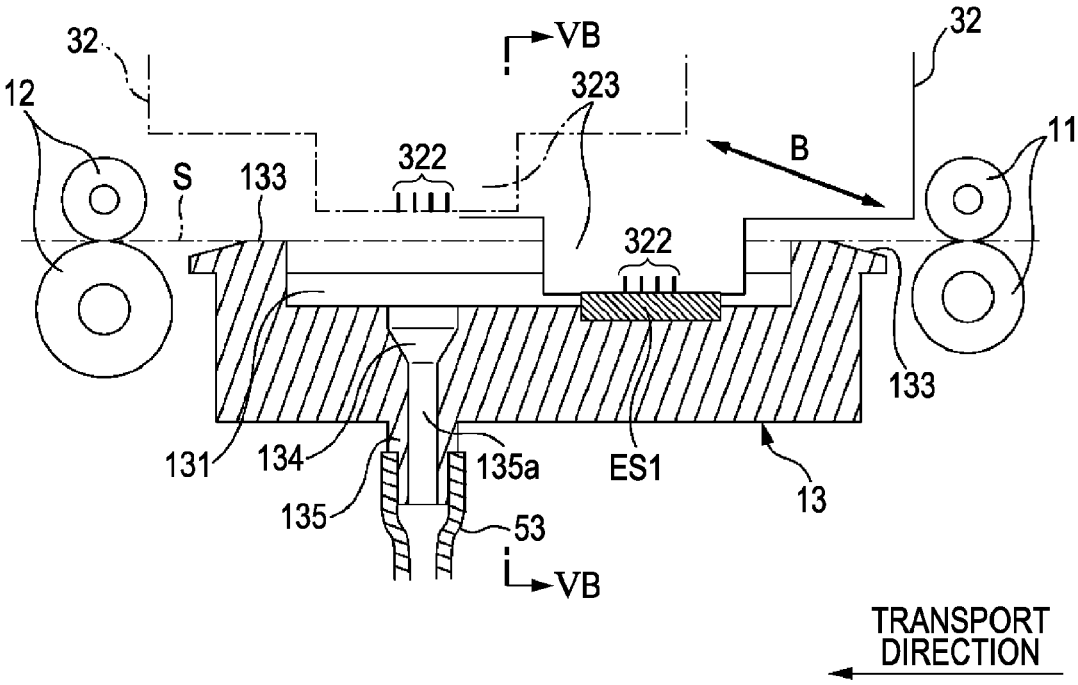
FIG. 5A is a view that illustrates the position of the head in a discharging state or the position of the head in a standby state.
Figure 5B:
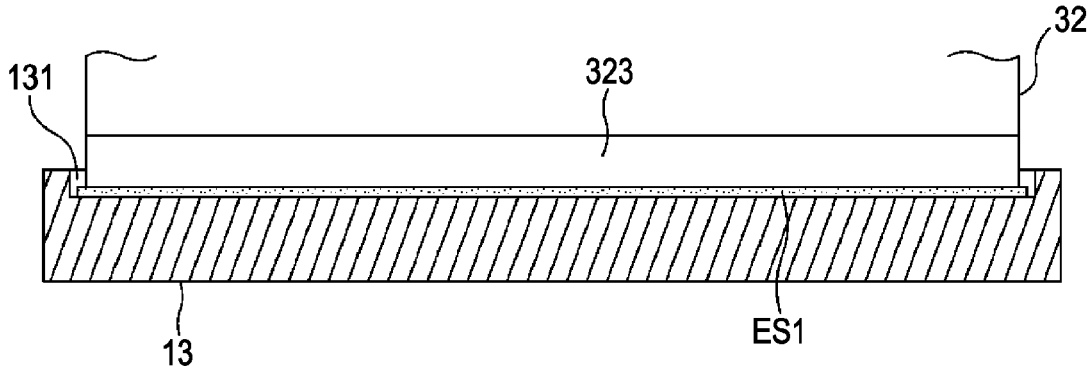
FIG. 5B is a cross-sectional view that is taken along the line VB-VB in FIG. 5A.

As shown in FIG. 5A, the paper transport mechanism 10 includes paper feeding rollers 11, paper delivery rollers 12, and the platen 13. The paper feeding rollers 11 are provided to the upstream side of the transport direction with respect to the platen 13. The paper feeding rollers 11 are used to send an unprinted portion of a sheet of paper to a print position. The paper delivery rollers 12 are provided to the downstream side in the transport direction with respect to the platen 13. The paper delivery rollers 12 are used to transport a printed portion of a sheet of paper in the transport direction.

Figure 4A:
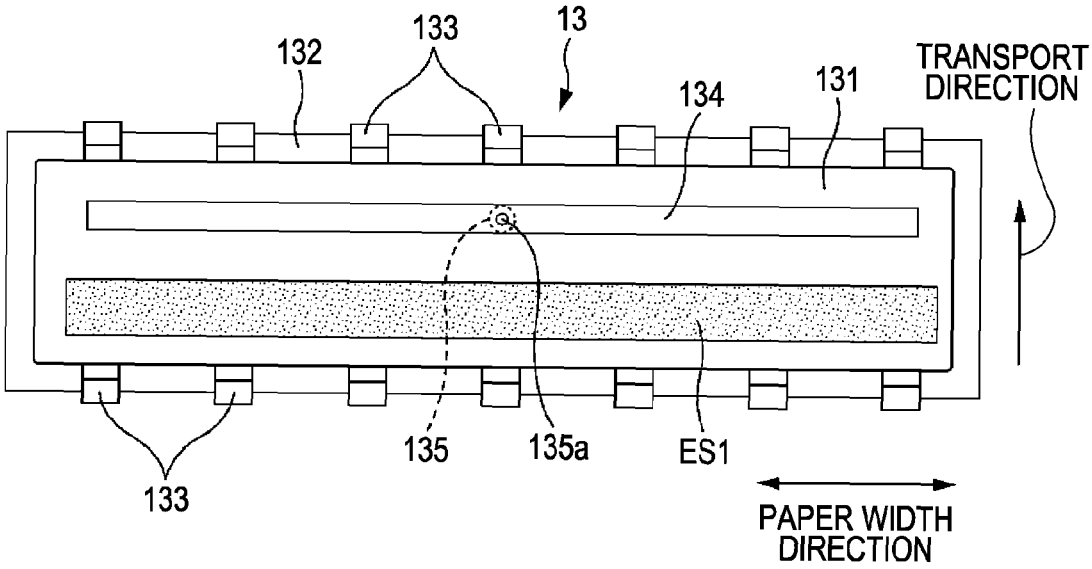
FIG. 4A is a plan view of a platen.
Figure 4B:
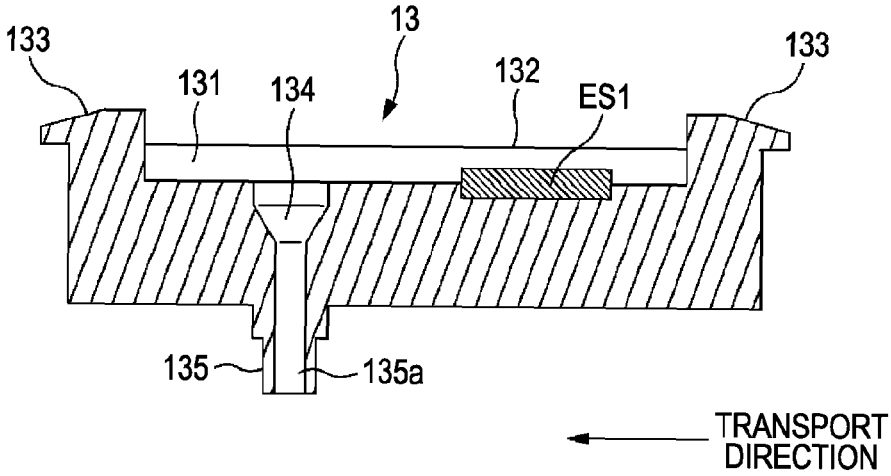
FIG. 4B is a cross-sectional view of the platen.

The platen 13 may be regarded as a medium support portion. The platen 13 supports a sheet of paper from the bottom, or face that is opposite to the face onto which ink lands, at a print position. Thus, as shown in FIG. 2, the platen 13 is arranged at a position that faces the plurality of nozzles 321 of the head 32. As shown in FIG. 4A, the platen 13 is formed of a plate-like member, wherein the upper face has a substantially rectangular shape. The length of the platen 13 in the longest direction (the side corresponding to the paper width direction) is set slightly greater than the width of a sheet of paper having a maximally printable size. This is so that the overall width of a sheet of paper may be supported even when the size of the sheet of paper is maximized. In addition, the shorter side of the platen 13, which is parallel to the transport direction, is provided in length that allows a sheet of paper to be held substantially parallel to the nozzle face. Furthermore, the platen 13 has a sufficient rigidity so as not to warp in the longitudinal direction. For example, by forming the platen 13 to have a sufficient thickness, warping is suppressed. This is because the platen 13 is a member that supports a sheet of paper. That is, if the platen 13 warps, a sheet of paper supported by the platen 13 also warps, so that it may cause degradation of image quality. In addition, the platen 13 has a high dimensional accuracy and a high flatness with respect to the head 32 (nozzle face). This is because, when a warped sheet of paper is supported, there is a possibility that the positions where the ink lands may deviate from their optimal positions. Therefore, the above feature is to prevent the deviation of the positions at which ink lands.

A recess 131 is formed on the upper face of the platen 13, which is opposite to the nozzles 321. The opening of the recess 131 has a rectangular shape having a size that is smaller than the outer shape of the platen 13. By forming the recess 131, a peripheral portion 132 is formed on the upper face of the platen 13. A plurality of guide portions 133 are provided to face the upper side (head 32 side) at the peripheral portion 132. These guide portions 133 support the sheet of paper from the rear face side in such a manner that the guide portions 133 are in contact with the sheet of paper.

An ink receiving groove 134 and a seal member ES1 are provided in the recess 131. The ink receiving groove 134 is a recess that faces the openings of the nozzles 321. The ink receiving groove 134 may be regarded as a fluid receiving portion that receives a fluid. Thus, the shape of the opening of the ink receiving groove 134 is formed in a rectangular shape so that it can accommodate the plurality of nozzles 321 inside. In the printer 1, the shape of the opening of the ink receiving groove 134 is formed in a rectangular shape with its longest side corresponding to the longitudinal direction of the platen 13. The ink receiving groove 134 mainly serves to receive ink that has been discharged from the nozzles 321 but has not landed on a sheet of paper and to receive ink that has been flushed from the head 32 in a maintenance operation (operation to place the head 32 in a normal state) of the nozzles 321. A communication port 135*a* is provided at the bottom portion of the ink receiving groove 134 and extends through the platen 13 in the thickness direction. The bottom face of the ink receiving groove 134 is inclined downward toward the communication port 135*a*. Thus, ink, which is received by the ink receiving groove 134, flows along the downward inclination of the bottom face toward the communication port 135*a*. On the rear face of the platen 13, opposite to the opening of the recess 131, a tube connecting portion 135 is provided at a portion that corresponds to the communication port 135*a*. A recovery tube 53 is connected to the tube connecting portion 135. The recovery tube 53 is used to connect the ink receiving groove 134 and the ink recovery portion 52. A suction pump 51 is arranged midway in the recovery tube 53. As the suction pump 51 is actuated, air or ink may be transferred from the ink receiving groove 134 side of the recovery tube 53 to the ink recovery portion 52 side. That is, a negative pressure may be applied to the side of the ink receiving groove 134. The suction pump 51 may be regarded as a negative pressure generating portion that generates a negative pressure. The suction pump 51 is in fluid communication with the ink receiving groove 134 through the recovery tube 53, and the like.

The seal member ES1 may be regarded as a contact member which contacts the nozzle face of the head 32. The seal member ES1 closes the opening of each nozzle 321 when the seal member ES1 contacts on the nozzle face. The seal member ES1 is a rectangular, elastic plate material having a size that is larger than the region where the plurality of nozzles 321 are formed. That is, the seal member ES1 is formed of a rectangular material having a size that is able to close all the nozzles 321 of the head 32 simultaneously. The seal member ES1 is made of an elastic, airtight and fluid-tight material such as elastomer, synthetic rubber, and sheeted gel. The seal member ES1 is arranged in the recess 131, so that it is substantially parallel to the ink receiving groove 134. As shown in FIG. 4A and FIG. 5A, the ink receiving groove 134 is arranged in the recess 131, downstream in the transport direction from the seal member ES1.

The seal member ES1 is positioned on the upper surface of the bottom face of the recess 131. Thus, when the nozzle face of the head 32 contacts the upper face of the seal member ES1, the upper side portion of the seal member ES1 is deformed or contracted in order to enhance adherence to the nozzle face. In this manner, it is possible to effectively suppress the outflow of ink from the nozzles 321. In addition, the seal member ES1 is provided at a position that is farther from the head 32 than a support position S where the sheet of paper is supported by the platen 13. In other words, the seal member ES1 is provided at a position that is deeper than the position where the guide portions 133 are provided. Thus, by providing the seal member ES1, it is possible to prevent ink that adheres to the seal member ES1 from contacting a sheet of paper. Hence, it is possible to prevent a sheet of paper from being smeared with ink.

Ink Recovery Mechanism 50 and Actuator Mechanism 60

The ink recovery portion 52 of the ink recovery mechanism 50 is in fluid communication with the platen 13 (ink receiving groove 134) through the recovery tube 53, as described above. The suction pump 51 is provided midway in the recovery tube 53. The suction pump 51 is used to transfer air or ink and, for example, employs a tube pump. Then, the suction pump 51 operates on the based on a suction signal from the printer-side controller 70. That is, the printer-side controller 70 controls a suction operation performed by the suction pump 51.

The actuator mechanism 60 is used to move the head 32 to a position where the head 32 is located close to the seal member ES1 to a position at which the head 32 is located away from the seal member ES1, and vice versa. As described above, the ink receiving groove 134 and the seal member ES1 are provided in the recess 131 of the platen 13.

In a discharging state in which the printer 1 discharges ink, the opening of each nozzle 321 faces the ink receiving groove 134. That is, as shown by the dashed line in FIG. 5A, the head 32 is positioned immediately above the ink receiving groove 134 (for the sake of convenience, this position is also referred to as upper side stop position). The reason why the opening of each nozzle 321 is located to face the ink receiving groove 134 at the upper side stop position is to capture ink which has been discharged from the nozzles 321 but has not landed on a sheet of paper in the ink receiving groove 134. At the upper side stop position, the nozzle face of the head 32 is positioned above the prospective transport position of the paper (indicated by the reference sign S in FIG. 5A), where the paper has been guided by the guide portions 133 of the platen 13. In this manner, a space through which a sheet of paper is allowed to pass is provided between the nozzle face (nozzles 321) and the seal member ES1.

On the other hand, during a standby state wherein the printer 1 is on standby and does not discharge ink, as shown by the solid line in FIG. 5A, the nozzle face contacts the seal member ES1 (for the sake of convenience, this position is also referred to as lower side stop position). At the lower side stop position, the opening of each nozzle 321 is closed by the seal member ES1. Here, the platen 13 has a high rigidity. The surface (bottom face of the recess 131) of the platen 13 to which the seal member ES1 is attached has a high flatness and dimensional accuracy with respect to the head 32. Thus, in this configuration, even when the seal member ES1 has an elasticity to such a degree that the seal member ES1 is pressed down when pressed by the head 32, the seal member ES1 may be adhered over the entire nozzle face having a length that is equal to or longer than the paper width. Hence, it is possible to prevent gaps from forming. As a result, it is possible to reliably close the nozzles 321 and, therefore, it is possible to effectively suppress vaporization of ink solvent. This is because the platen 13 can withstand a pressing force applied by the head 32 and the surface of the platen 13 has a high flatness.

These ink receiving groove 134 and seal member ES1 are provided in offset positions in the transport direction inside the recess 131. Thus, the actuator mechanism 60, as shown by the arrow B in FIG. 5A, moves the head 32 obliquely upward or obliquely downward. That is, when the head 32 is switched from the discharging state to the standby state, the head 32 is moved obliquely downward from the upper side stop position to the upstream side in the transport direction. In addition, when the head 32 is switched from the standby state to the discharging state, the head 32 is moved obliquely upward from the lower side stop position to the downstream side in the transport direction. The actuator mechanism 60 may employ any configuration so long as it can move the head 32. For example, the direction in which the head 32 is moved may be determined in such a manner that a guide shaft guided by a guide groove is formed to extend from each side face of the head 32. In this configuration, the printer-side controller 70 outputs a movement control signal to a power source (for example, motor). That is, the printer-side controller 70 controls movement of the head 32 by the actuator mechanism 60.

Operation of Printer 1

In the standby state when the printer 1 is on standby and does not discharge ink onto a sheet of paper, the printer-side controller 70 moves the head 32 to the lower side stop position. In this manner, the openings of the plurality of nozzles 321 are closed by bringing the seal member ES1 into contact with the nozzle face of the head 32. As a result, vaporization of ink solvent through the nozzles 321 is suppressed. On the other hand, in the discharging state when the printer 1 discharges ink onto a sheet of paper, the printer-side controller 70 moves the head 32 to the upper side stop position. In this manner, the head 32 is located away from the seal member ES1 and a space is created through which a sheet of paper is allowed to pass between the openings of the nozzles 321 and the platen 13 (seal member ES1). Similarly, when flushing or pressure application cleaning process is performed, during which ink is discharged from the head 32, the printer-side controller 70 moves the head 32 to the upper side stop position. Hereinafter, the operations of the printer 1, particularly regarding these controls, will be described.

Figure 6:
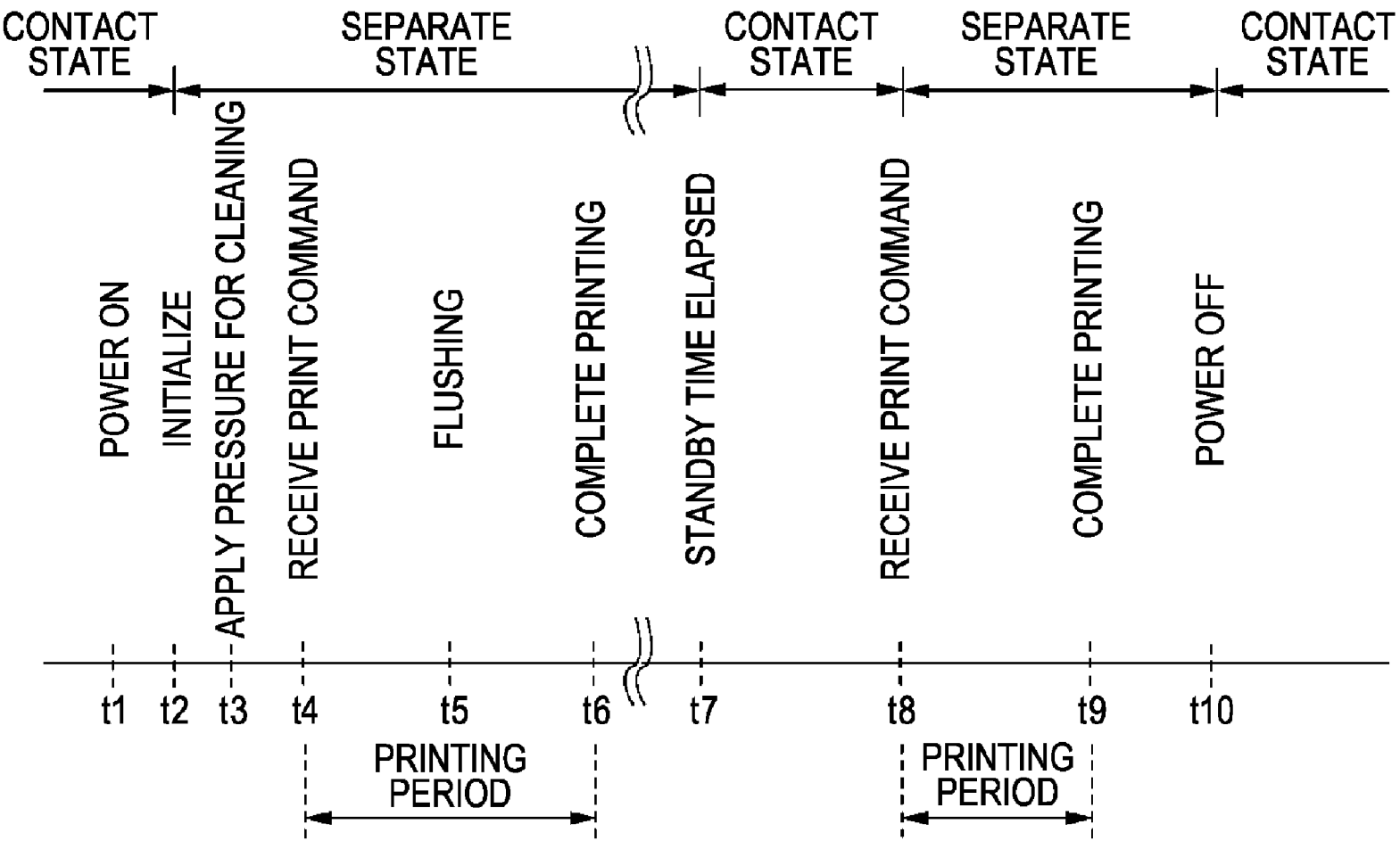
FIG. 6 is a view that illustrates the flow of operations.

FIG. 6 is a view that shows a series of processes performed by the printer 1. These processes are executed in such a manner that the CPU of the printer-side controller 70 controls various portions in accordance with a computer program stored in a memory. Thus, the computer program has codes for executing these processes.

In the exemplified process, as the power of the printer 1 is turned on (t1), an initializing operation is executed (t2). During the initializing operation, initialization of the printer 1 is performed. For example, the process may include reading a program and checking the status of various portions of the apparatus. Here, the printer-side controller 70 moves the head 32 to the upper side stop position. That is, the printer-side controller 70 sets the state to a separate state wherein the platen 13 (seal member ES1) and the head 32 (nozzle face) are located away from each other. After the initializing operation, a pressure application cleaning process is performed (t3). The pressure application cleaning process is an operation in which ink in the head 32 is forcibly flushed by applying pressure to ink in the ink cartridge 41. The pressure application cleaning process is a kind of maintenance operation for the nozzles 321. In the pressure application cleaning process, the printer-side controller 70 applies pressure to ink in the ink cartridge 41 by outputting a pressure application signal to the pressure application pump 42. In this manner, ink is drained through the nozzles 321. Then, the ink lands in the ink receiving groove 134 that is provided for the platen 13. In addition, the printer-side controller 70 outputs a suction signal to the suction pump 51 in order to drain ink in the ink receiving groove 134. In this manner, the suction pump 51 operates to vacuum ink in the ink receiving groove 134 and then sends the ink to the ink recovery portion 52.

After completing the pressure application cleaning process, the printing preparation process ends. Thus, the printer-side controller 70 waits a print command from the computer CP. Then, as the printer-side controller 70 receives a print command (t4), the printer-side controller 70 executes a printing operation. During a printing period when the printing operation is performed, the printer-side controller 70 performs a flushing operation at predetermined intervals (t5). For example, when printing is performed on multiple sheets of paper, the printer-side controller 70 may perform a flushing operation in-between printing the sheets of paper. During the flushing operation, by applying a driving signal COM to a driving element, ink is discharged from the nozzle 321. Ink that is discharged in the flushing operation is also received by the ink receiving groove 134. As the flushing operation ends, printing on the remaining sheets of paper is performed (t5-t6).

After completing the printing operation, when the printer-side controller 70 does not receive a print command and a predetermined standby time has elapsed, the printer-side controller 70 switches the mode to a standby state (t7). In the standby state, the head 32 is moved to the lower side stop position, and then the nozzle face is brought into contact with the seal member ES1. In this manner, it is possible to suppress thickening of ink near the nozzles 321. Then, this contact state is continued until the next print command is received from the computer CP (t7-t8).

As the printer-side controller 70 receives a print command, the printer-side controller 70 moves the head 32 to the upper side stop position to thereby set the state to a separate state. Then, a printing operation based on the received print command is performed (t8-t9). In this example of operation, after completion of the printing operation, power is switched to an off state (t10). At this time, because the head 32 is placed at the upper side stop position (separate state), the printer-side controller 70 moves the head 32 to the lower side stop position to bring the nozzle face into contact with the seal member ES1 and then turns off the power. In this manner, in a period when power is turned off as well, because the openings of the nozzles 321 are closed by the seal member ES1, vaporization of solvent through the nozzles 321 is effectively suppressed.

Conclusion

In the printer 1, a platen 13 having a high rigidity is provided with the seal member ES1. By bringing the nozzle face of the head 32 into contact with the seal member ES1, the openings of the nozzles 321 are closed. Here, because the seal member ES1 is attached to the platen 13, it is possible to improve adherence between the seal member ES1 and the nozzle face in the contact state (sealed state). In this manner, in the contact state, it is possible to suppress vaporization of ink solvent and thereby it is possible to effectively suppress the thickening of ink.

In addition, in the present embodiment, the ink receiving groove 134 and the seal member ES1 are arranged on the same face in the platen 13. Thus, when the separate state and the contact state are switched, it is possible to minimize the distance that the head 32 has to move. In this manner, it is possible to perform a switching operation in a short period of time.

Second Embodiment

In the first embodiment, both the ink receiving groove 134 and the seal member ES1 are provided on the face (the recess 131 of the platen 13) opposite the openings of the nozzles 321 in the platen 13. In this configuration, the ink receiving groove 134 and the seal member ES1 are provided in the recess 131 of the platen 13 a predetermined distance apart in the transport direction. Thus, the size of the platen 13 increases by an amount in order to provide a space for the ink receiving groove 134 and the seal member ES1. In the second embodiment shown in FIG. 7, however, the seal member ES2 (which may be regarded as a contact member) is rotatably provided above the same space as in the ink receiving portion 136 (which may be regarded as a fluid receiving portion), such that in the standby state, the seal member ES2 is brought into contact with the nozzle face of the head 32.

In this embodiment, the platen 13 has a box shape which has a length that corresponds to the width of the paper and one opened face. The space inside the platen 13 is provided as the ink receiving portion 136 that receives ink. The opening of the ink receiving portion 136 has a rectangular shape having a size that is larger than the nozzle face (the shape of the bottom face of the extended portion 323). In addition, the ink receiving portion 136 has a depth that is almost equivalent to the width of the opening. The seal member ES2 is a rectangular member having a size that is smaller than the opening of the ink receiving portion 136. As in the case of the seal member ES1 according to the first embodiment, the seal member ES2 is made of an elastic material such as elastomer.

A bearing portion BB is provided at one of the long sides of the seal member ES2. The bearing portion BB is formed into a cylindrical shape, and a support shaft X is inserted into the bearing portion BB. Thus, the seal member ES2 is rotatably attached about the bearing portion BB. Note that both ends of the support shaft X may be attached to the platen 13 or may be attached to the frame of the printer 1. The pivotal movement of the seal member ES2 is controlled by a rotation driving source, such as a motor and a pressing spring. In this embodiment, the seal member ES2 is pivoted between a position indicated by the solid line and a position indicated by the dashed line in FIG. 7.

Figure 7:
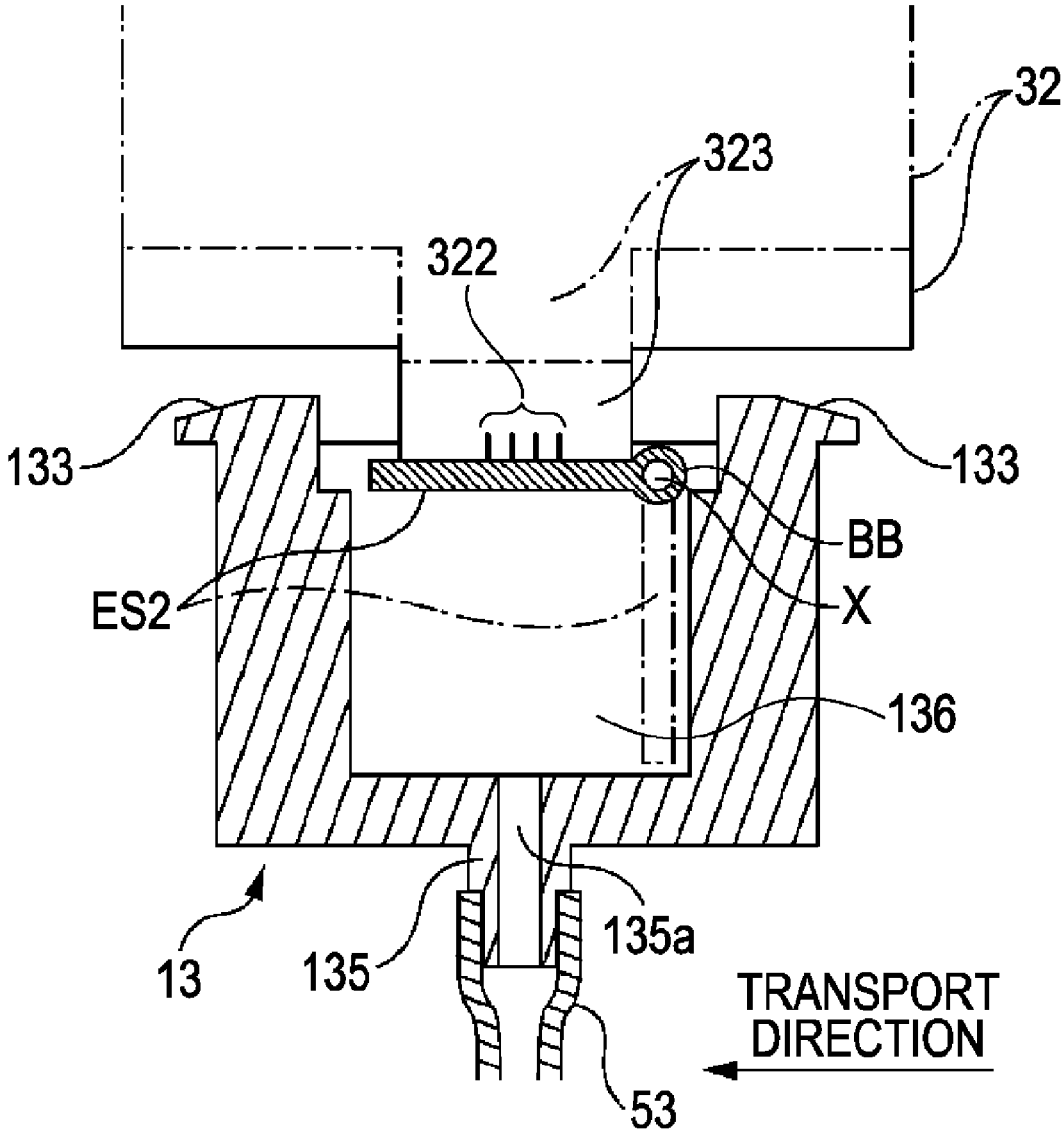
FIG. 7 is a view that illustrates a second embodiment and is a cross-sectional view of a platen.

At the position indicated by the solid line in FIG. 7, the free end (one of the long sides at which the bearing portion BB is not provided) of the seal member ES2 is raised to the same level as the bearing portion BB. In this manner, the seal member ES2 is positioned in a substantially horizontal orientation, and the opening of the ink receiving portion 136 is covered (which corresponds to a first state). In accordance with this, the seal member ES2 faces the nozzle face of the head 32. On the other hand, at a position indicated by the dashed line, the free end of the seal member ES2 may be positioned substantially immediately under the bearing portion BB, when the seal member ES2 is positioned in a substantially vertical orientation. In this manner, the seal member ES2 is placed in a state where the face that contacts the head 32 is retracted away from the head 32, that is, the face that contacts the head 32 is retracted away from a passage through which ink passes (which corresponds to a second state).

In this printer 1, the head 32 is switched from the contact state to the separate state by the initializing operation by the printer-side controller 70 outputting a control signal to the rotation driving source (motor, or the like) for the seal member ES2 in order to switch the seal member ES2 to the second state. Then, by moving the head 32 to the upper side stop position, a space is formed through which a sheet of paper is allowed to pass between the nozzle face and the platen 13. In this manner, ink that has been discharged from the nozzles 321 but has not landed on a sheet of paper is received by the ink receiving portion 136. Note that the communication port 135*a* is provided at the bottom face of the ink receiving portion 136, as in the case of the first embodiment. Thus, by actuating the suction pump 51, ink that has landed on the ink receiving portion 136 may be sent to the ink recovery portion 52. Then, as the switching condition to the standby state is satisfied, the printer-side controller 70 switches the seal member ES2 to the first state. In addition, by moving the head 32 downward, the nozzle face is brought into contact with the seal member ES2. As the nozzle face is brought into contact with the seal member ES2, the seal member ES2 closes the nozzles 321. Thus, it is possible to suppress vaporization of ink solvent through the nozzles 321.

As described above, in the printer 1 according to the second embodiment, because the seal member ES2 is pivotally provided in the ink receiving portion 136, it is possible to suppress vaporization of ink solvent through the openings of the nozzles 321 and it is also possible to reduce the size of the printer 1.

Third Embodiment

Figure 8A:
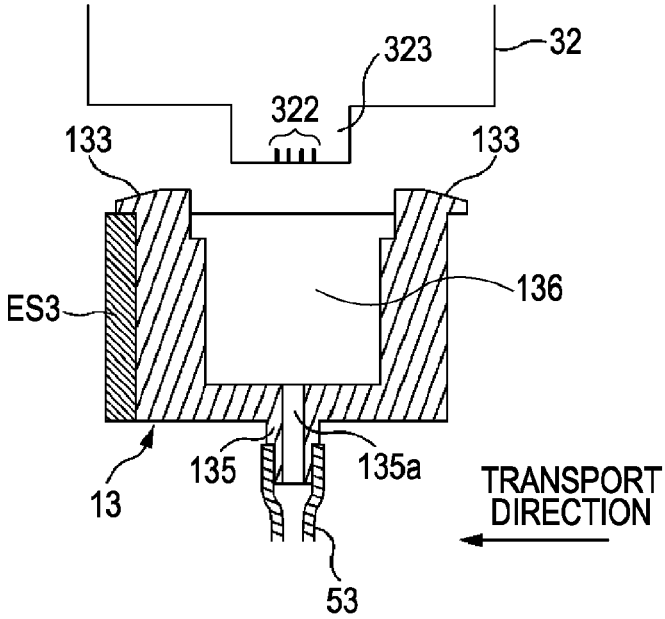
FIG. 8A is a view that illustrates a third embodiment and is a cross-sectional view of a platen in a discharging state.

In the second embodiment, the seal member ES2 is provided in the ink receiving portion 136; however, the position at which the seal member ES2 is provided is not limited to this configuration. For example, as shown in FIG. 8A, a seal member ES3 (a contact member) may be provided on the side face of the platen 13.

Figure 8B:
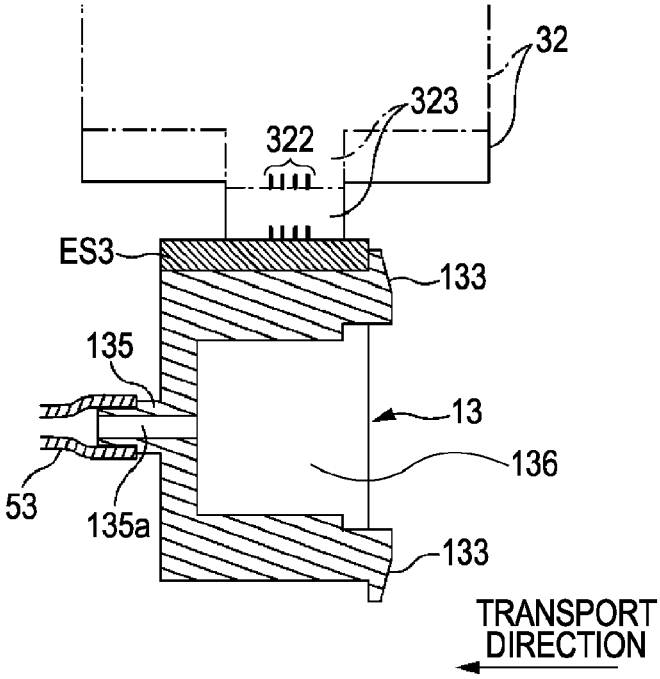
FIG. 8B is a view that illustrates the third embodiment and is a cross-sectional view of the platen in a contact state.

The seal member ES3 is provided on the side face of the platen 13, that is, specifically, on a side face that is different from the open face where the ink receiving portion 136 is located. Similar to the configurations above, the seal member ES3 extends in the paper width direction. In this embodiment, the actuator mechanism 60 pivots the platen 13. That is, the platen 13 is pivoted between a state in where the opening of the ink receiving portion 136 faces the nozzle face (separate state shown in FIG. 8A) and a state in where the face that contacts the seal member ES3 faces the nozzle face (contact state shown in FIG. 8B).

In this printer 1, the head 32 and platen 13 are switched from the contact state to the separate state by the initializing operation. At this time, the printer-side controller 70 outputs a control signal to the actuator mechanism 60 to thereby stop the head 32 at the upper side stop position. In this manner, a space is formed through which a sheet of paper is allowed to pass between the nozzle face and the platen 13. In addition, the actuator mechanism 60 pivots the platen 13, so that the opening of the ink receiving portion 136 faces the nozzle face. In this manner, ink that has been discharged from the nozzles 321 but has not landed on a sheet of paper is received by the ink receiving portion 136. Then, as the switching condition to the standby state is satisfied, the head 32 and platen 13, are switched from the contact state to the separate state. At this time, the actuator mechanism 60 pivots the platen 13, so that the seal member ES3 faces the nozzle face. In addition, the actuator mechanism 60 moves the head 32 vertically, so that the nozzle face is brought into contact with the seal member ES3. Thus, it is possible to suppress vaporization of ink solvent through the nozzles 321.

In the printer 1 according to the third embodiment, because the seal member ES3 is provided on the side of the platen 13 and the platen 13 is pivotable, it is possible to suppress vaporization of ink solvent through the openings of the nozzles 321 and it is also possible to reduce the size of the printer 1.

Other Embodiments

The above embodiments are intended to illustrate the aspects of the invention and are not intended to limit the scope of the invention. The aspects of the invention may be modified or improved without departing from the spirit of the invention and, of course, include the equivalents thereof. Particularly, the following embodiments are also included in the scope of the invention.

The above described printer 1 has a single long head 32, however, a plurality of connected short heads may be used. For example, a line head unit may be configured so that a plurality of short heads are arranged in a staggered manner.

In addition, in the above described embodiments, the printer 1 is described as the fluid discharging apparatus, but the invention is not limited to this configuration. The aspects of the invention may be embodied as a fluid discharging apparatus that ejects or discharges a fluid other than ink (which includes liquid, a liquid body in which particles of functional material are dispersed, a flowage body such as gel, solid that may be flowed and discharged as a fluid).

For example, the fluid discharging apparatus may be a liquid body discharging apparatus that discharges a liquid material such as an electrode material or a color material, which is used for manufacturing a liquid crystal display, an EL (electroluminescence) display or a field emission display, or in a liquid discharging apparatus that discharges a bio-organic material used for manufacturing a bio-chip, or a liquid discharging apparatus that is used as a precision pipette and discharges a sample of liquid.

Furthermore, the fluid discharging apparatus may be a liquid discharging apparatus that discharges a pinpoint amount of lubricant oil within a precision machine, such as a clock, a watch or a camera, a liquid discharging apparatus that discharges a transparent resin liquid, such as an ultraviolet curing resin, for forming a microscopic semi-spherical lens (optical lens) used for an optical communication element, or the like. The fluid discharging apparatus may also discharge a liquid onto a substrate, including an etchant, such as acid or alkali, in order to perform etching on the substrate, or the like. Additionally, the fluid discharging apparatus may also comprise a flowage discharging apparatus that ejects a gel, or fine particle ejection recording apparatus that ejects solid of particles such as a toner.

What is claimed is:

1. A fluid discharging apparatus comprising:

a head that includes a plurality of nozzles through which a fluid is discharged onto a surface of a target medium, wherein the plurality of nozzles are provided at least over the width of the target medium in a direction that is orthogonal to the direction that the target medium is transported through the fluid discharging apparatus;

a medium support portion that faces the plurality of nozzles which is provided at least over the width of the target medium and which supports the target medium on the side that is opposite to the surface where the fluid is discharged, wherein the target medium is not a part of the medium support portion;

a contact member within the medium support portion; and an actuator portion that is capable of moving at least one of the head and the medium support portion so that the plurality of nozzles are located close to or away from the contact member, wherein the contact member is brought into contact with the head when the apparatus is in a standby state wherein fluid is not discharged onto the target medium in order to close the plurality of nozzles, and the head is located away from the contact member in a vertical direction during a discharging state when the fluid is discharged onto the target medium in order to create a space in the vertical direction through which the medium is allowed to pass between the opening between the plurality of nozzles and the contact member, wherein the contact member is provided such that a contact portion where the contact member contacts the head during the standby state is located farther from the head than the medium support portion.

2. The fluid discharging apparatus according to claim 1, wherein the medium support portion has a fluid receiving portion capable of receiving the fluid discharged from the nozzles.

3. The fluid discharging apparatus according to claim 2, further comprising:

a fluid supply portion capable of supplying a pressurized fluid to a side of the head in order to flush the fluid within the head, wherein the fluid receiving portion receives the fluid that has been flushed from the head through the nozzles.

4. The fluid discharging apparatus according to claim 2, wherein the contact member is provided on a side of the fluid receiving portion of the medium support portion, and in the discharging state, the openings of the plurality of nozzles face the fluid receiving portion such that the fluid receiving portion may receive fluid which has been discharged from the nozzles that does not land on the medium.

5. The fluid discharging apparatus according to claim 2, wherein the contact member is rotatably provided in the fluid receiving portion, such that during the standby state, the contact member is brought into a first state wherein a contact portion of the contact member seals the plurality of nozzles, and in the discharging state, the contact member is brought into a second state wherein the contact portion is retracted away from the head, and fluid which has been discharged from the nozzles but has not landed on the medium is received by the fluid receiving portion.

6. The fluid discharging apparatus according to claim 2, wherein the contact member is provided on a side of the medium support portion that is different from an open face where the fluid receiving portion is located, wherein in the standby state, the medium support portion is pivoted so that a contact portion where the contact member contacts the head faces and is brought into contact with the plurality of nozzles, and in the discharging state, the medium support portion is pivoted so that the fluid receiving portion faces the plurality of nozzles, and fluid which has been discharged from the nozzles that does not land on the medium is received by the fluid receiving portion.

7. A fluid discharging apparatus comprising:

a head that includes a plurality of nozzles through which a fluid is discharged onto a surface of a target medium, wherein the plurality of nozzles are provided at least over the width of the target medium in a direction that is orthogonal to the direction that the target medium is transported through the fluid discharging apparatus;

a medium support portion which includes a contact member which faces the plurality of nozzles and a receiving portion capable of receiving the fluid discharged from the nozzles, the medium support portion being provided at least over the width of the target medium and being capable of supporting the target medium on the side that is opposite to the surface where the fluid is discharged, wherein the target medium is not a part of the medium support portion; and an actuator portion that is capable of moving either the head or the medium support portion so that the plurality of nozzles are located close to the contact member when the apparatus is in a standby state wherein fluid is not being discharged onto the target medium in order to close the plurality of nozzles, or away from the contact in order to create a space in the vertical direction through which the medium is allowed to pass between the opening between the plurality of nozzles and the contact member when the apparatus is in a discharging state, wherein the contact member is provided such that a contact portion where the contact member contacts the head during the standby state is located farther from the head than the medium support portion.

8. The fluid discharging apparatus according to claim 7, further comprising:

a fluid supply portion capable of supplying a pressurized fluid to a side of the head in order to supply the fluid discharged from the head, wherein the fluid receiving portion receives the fluid that has been discharged from the head through the nozzles.

9. The fluid discharging apparatus according to claim 7, wherein the contact member is provided on a side of the fluid receiving portion of the medium support portion, and in the discharging state, the openings of the plurality of nozzles face the fluid receiving portion such that the fluid receiving portion may receive fluid which has been discharged from the nozzles that does not land on the medium.

10. The fluid discharging apparatus according to claim 7, wherein the contact member is rotatably provided in the fluid receiving portion, such that during the standby state, the contact member is brought into a first state wherein a contact portion of the contact member seals the plurality of nozzles, and in the discharging state, the contact member is brought into a second state wherein the contact portion is retracted away from the head, and fluid which has been discharged from the nozzles but has not landed on the medium is received by the fluid receiving portion.

11. The fluid discharging apparatus according to claim 7, wherein the contact member is provided on a side of the medium support portion that is different from an open face where the fluid receiving portion is located, wherein in the standby state, the medium support portion is pivoted so that a contact portion where the contact member contacts the head faces and is brought into contact with the plurality of nozzles, and in the discharging state, the medium support portion is pivoted so that the fluid receiving portion faces the plurality of nozzles, and fluid which has been discharged from the nozzles that does not land on the medium is received by the fluid receiving portion.

12. A fluid discharging apparatus comprising:

a head that includes a plurality of nozzles through which a fluid is discharged onto a surface of a target medium, wherein the plurality of nozzles are provided at least over the width of the target medium in a direction that is orthogonal to the direction that the target medium is transported through the fluid discharging apparatus;

a medium support portion that faces the plurality of nozzles which supports the target medium on the side that is opposite to the surface where the fluid is discharged;

a contact member within the medium support portion; and an actuator portion that is capable of moving at least one of the head and the medium support portion so that the plurality of nozzles are located close to or away from the contact member, wherein the contact member is brought into contact with the head when the apparatus is in a standby state wherein fluid is not discharged onto the target medium in order to close the plurality of nozzles, and the head is located away from the contact member during a discharging state when the fluid is discharged onto the target medium in order to create a space, through which the medium is allowed to pass between the opening between the plurality of nozzles and the contact member, wherein the medium support portion has a fluid receiving portion capable of receiving the fluid discharged from the nozzles, wherein the contact member is rotatably provided in the fluid receiving portion, such that during the standby state, the contact member is brought into a first state wherein a contact portion of the contact member seals the plurality of nozzles, and in the discharging state, the contact member is brought into a second state wherein the contact portion is retracted away from the head, and fluid which has been discharged from the nozzles but has not landed on the medium is received by the fluid receiving portion.

13. A fluid discharging apparatus comprising:

a head that includes a plurality of nozzles through which a fluid is discharged onto a surface of a target medium, wherein the plurality of nozzles are provided at least over the width of the target medium in a direction that is orthogonal to the direction that the target medium is transported through the fluid discharging apparatus;

a medium support portion which includes a contact member which faces the plurality of nozzles and a receiving portion capable of receiving the fluid discharged from the nozzles, the medium support portion being capable of supporting the target medium on the side that is opposite to the surface where the fluid is discharged; and an actuator portion that is capable of moving either the head or the medium support portion so that the plurality of nozzles are located close to the contact member when the apparatus is in a standby state wherein fluid is not being discharged onto the target medium in order to close the plurality of nozzles, or away from the contact in order to create a space, through which the medium is allowed to pass between the opening between the plurality of nozzles and the contact member when the apparatus is in a discharging state, wherein the contact member is rotatably provided in the fluid receiving portion, such that during the standby state, the contact member is brought into a first state wherein a contact portion of the contact member seals the plurality of nozzles, and in the discharging state, the contact member is brought into a second state wherein the contact portion is retracted away from the head, and fluid which has been discharged from the nozzles but has not landed on the medium is received by the fluid receiving portion.

* * * * *